United States Patent [19]

Robinson

[11] 4,044,419

[45] Aug. 30, 1977

[54] MOP WRINGER

[75] Inventor: Paul E. Robinson, Adelaide, Australia

[73] Assignee: Sabco Limited, Albert Park, Australia

[21] Appl. No.: 661,130

[22] Filed: Feb. 25, 1976

[30] Foreign Application Priority Data

Mar. 6, 1975 Australia ..... 0814/75

[51] Int. Cl.[2] ..... A47L 13/146

[52] U.S. Cl. ..... 15/119 A

[58] Field of Search ..... 15/116 A, 119 A

[56] References Cited

U.S. PATENT DOCUMENTS

| | | | |
|---|---|---|---|
| 2,643,407 | 6/1953 | Vosbikian et al. | 15/119 A |
| 2,779,959 | 2/1957 | Hvale | 15/119 A |
| 2,967,317 | 1/1961 | Richards | 15/119 A |
| 3,224,025 | 12/1965 | Altrock | 15/119 A |
| 3,806,982 | 4/1974 | Park | 15/119 A |

*Primary Examiner*—Daniel Blum

*Attorney, Agent, or Firm*—Oldham & Oldham Co.

[57] ABSTRACT

A squeeze mop having a pair of wings pivoted to a central part of the mop body, and a one piece lever and actuating mechanism pivoted adjacent the end of the handle. The lever is integrally connected to a pair of spaced actuators straddling the handle and acting on each wing so that the initial closing movement gives a rapid closing movement, and further movement gives a closing movement with an increased mechanical advantage.

6 Claims, 4 Drawing Figures

MOP WRINGER

This invention relates to squeeze mops and more particularly to a mop wherein the squeezing action is accomplished in a simple and effective manner.

BACKGROUND OF THE INVENTION

Squeeze mops are known wherein a flat rectangular sponge or sponge like material is mounted on a holder which is hinged about its centre so that the two ends can be folded or hinged towards each other so that the sponge is folded and squeezed against itself in order to squeeze out and expel suds or other liquids.

Various forms of mechanisms are known which cause the required movement. One known type includes a sleeve slidable along the handle of the mop, the sleeve being connected by a rod to a yoke pivoted at its ends to a bracket affixed to the end of the handle, rollers on the arms of the yoke acting on each of the wings to pivot the wings towards each other to produce the squeezing action. However such a mechanism has a large number of parts and thus requires a laborious assembly procedure, and also the action is often difficult to actuate, the squeezing action being produced by a push-pull action with the sleeve sliding along the handle.

Other forms require the use of a pivotal handle pivoted on the mop handle spaced from the end thereof with a linkage arrangement to cause the movement of the wings of the mop head.

SUMMARY OF THE INVENTION

The squeeze mop according to the invention includes a pair of pivoted wings pivoted to a central part of the mop body, and a one piece lever and actuating mechanism pivoted adjacent the end of the handle, the lever being integrally connected to a pair of spaced actuators straddling the handle and acting on each wing adjacent its hinge, the actuation being such that an initial movement gives a rapid closing of pivoting movement of the wings, and that on further movement of the lever an action with an increased mechanical advantage causes the final closing and squeezing action.

DESCRIPTION OF THE PREFERRED EMBODIMENT

Figure 1:
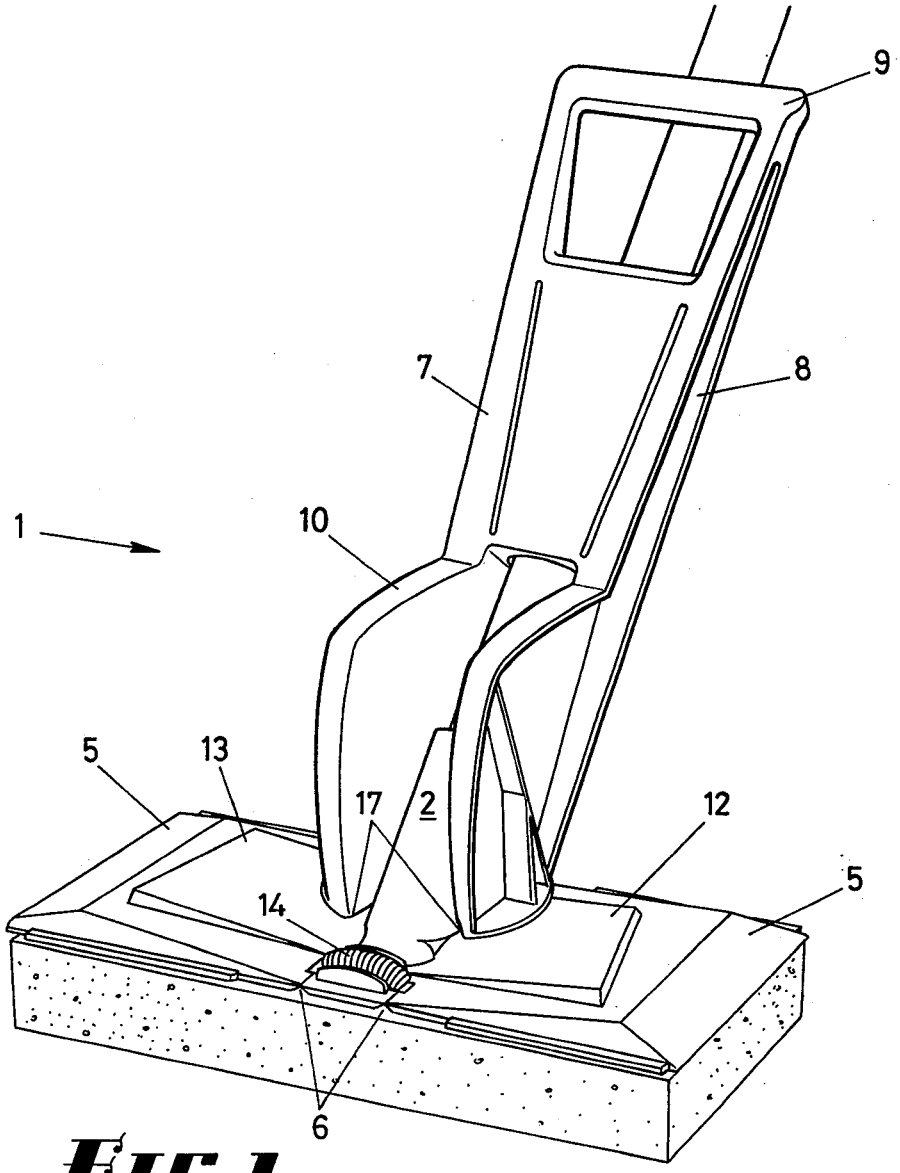
FIG. 1 is a front perspective view of the apparatus in the open position.

Preferably the mop 1 is formed of one of the rigid plastics materials with the centre portion 2 being formed with a socket 3 or the like to take the mop handle 4. The wings 5, 5, are formed integral with the centre portion 2 by an integral flexible hinge 6 formed therebetween, the hinges 6 being spaced from each other so that in the squeezed position the wings are generally parallel to each other.

A one piece lever and actuator 7 is hinged to the centre portion 2 adjacent the ends of the handle and comprises a pair of parallel members 8 joined at the upper end to form the lever 9 and at the lower end forming a pair of parallel planar surfaces or walls 10, the ends 11 of the walls being flat and in the open position resting on the wings 5.

Each wing 5 has its upper surface 12 formed with a tapered surface 13 tapering slightly upwardly from the hinge line 6. This tapered surface as shown is provided by a wedge shaped moulding formed on the wings, but it is realised that this tapered surface may be of different configuration or the wings may be provided with parallel surfaces, for the tapered surface is not essential but gives a preferred closing action.

Figure 3:
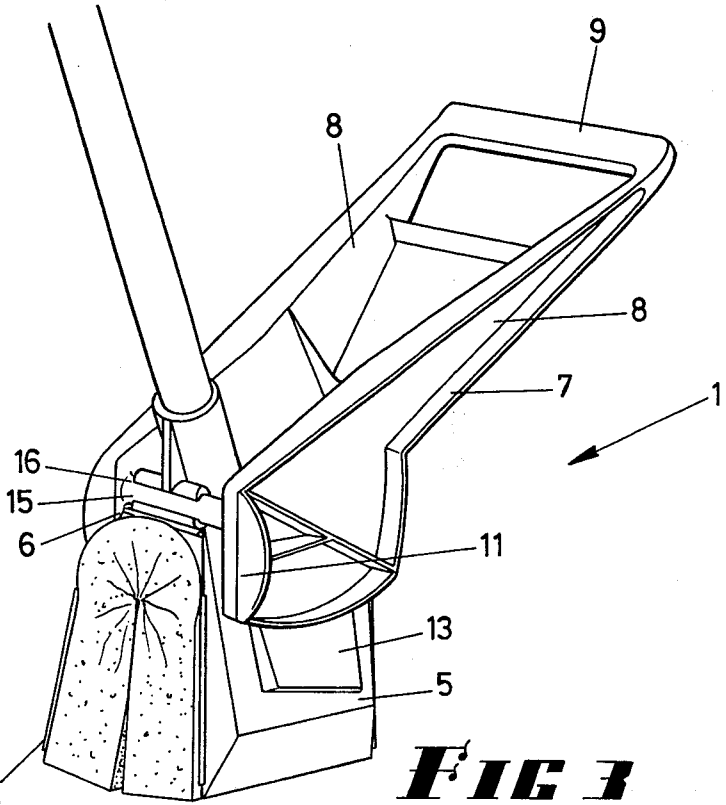
FIG. 3 is a view similar to FIG. 2 showing the mop in the closed or squeezed position.
Figure 2:
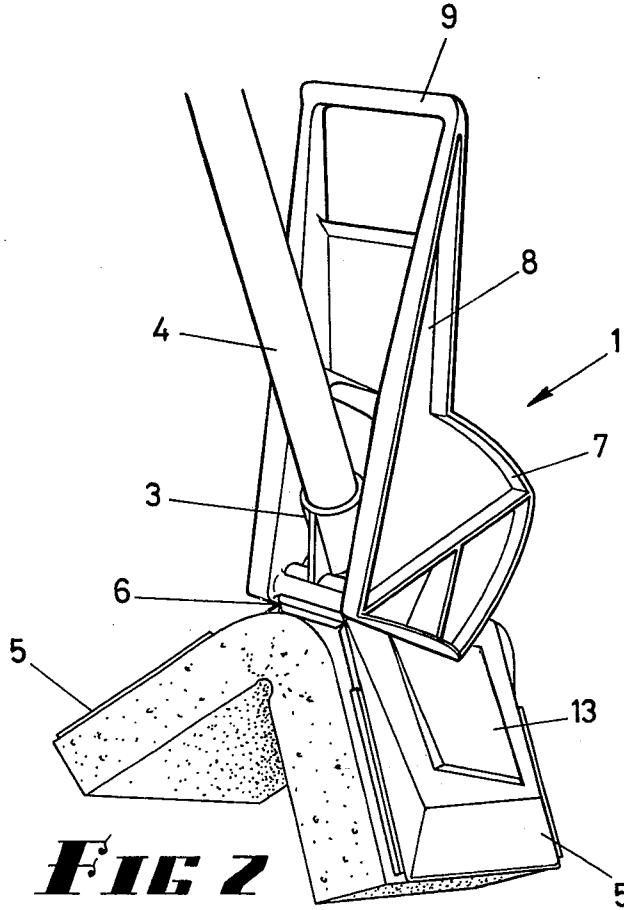
FIG. 2 is a rear perspective view at the beginning of the closing action.
Figure 4:
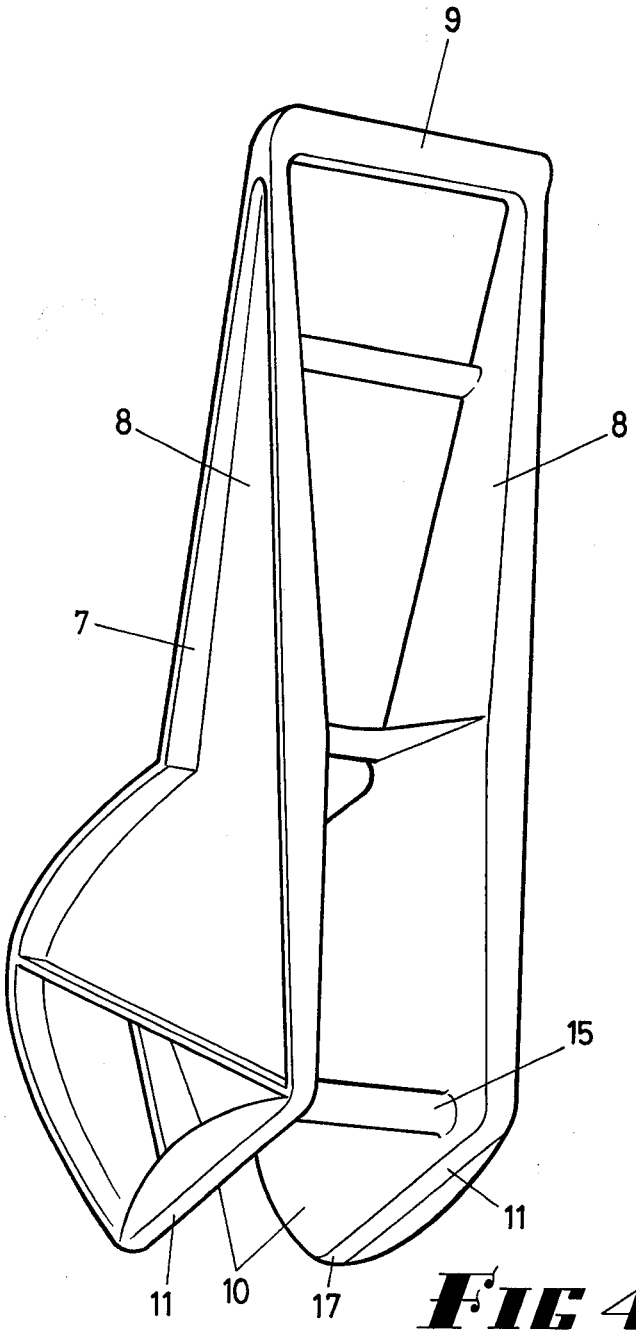
FIG. 4 shows a perspective view of the operating lever and actuating mechanism.

At its lower end the actuator 7 is provided with a pivot bar 15, this bar being clipped into a socket 16 formed on the rear of the centre portion 2 of the mop, to thus allow the actuator to pivot relative to the mop 1, from the position shown in FIG. 1 through the position shown in FIG. 2 to the position shown in FIG. 3.

Means are provided to retain the wings in the flat position, and preferably this can be by a tension spring 14 joining the two wings. The ends of the spring passing through apertures in the wings adjacent the hinge line, and hooked over pins formed on the under surface of the wings.

The lever 9 in its inoperative position lies adjacent the mop handle 4, and on moving the lever 9 downwardly and away from the mop handle 4 the squeezing takes place, and the lever 9 forming a large lever arm to cause the squeezing action to take place, the squeezing action thus being produced with a large mechanical advantage.

Hence the mop can be formed in two basic parts only, the mop and wings, and the integral lever and actuator which is clipped into its pivotal socket mounted on the mop head.

In operation as shown in FIG. 1 the upper surface of the wings is in contact with the ends of the members, these effectively forming a stop to limit the upward movement of the wings beyond the generally horizontal position.

On moving the lever away from the handle as shown in FIG. 2 the heel portion 17 of the actuator moves and initially causes the first movement of the wings towards pivot to each other.

This initial movement is a relatively rapid movement and after this has taken place, the inner walls 10 then slide over the surfaces 12. Due to the shape of the actuator, the heel 17 moves over the surface 12 at a progressively further distance from the hinge line 6, thus further moving the wings towards each other, and then finally the wings close to such an extent that the inner walls 10 move over the surfaces 12. Due to the wedge shaped surface 13 of the wings, there is a final closing action with a large mechanical advantage to effect the final squeezing of the sponge.

The walls 10 are spaced apart a distance which is the same as but preferably slightly greater than the spacing between the hinges 6, or in other words a distance to pass over the centre portion 2 of the mop, so that the actuator engages the wings to squeeze them together.

The pivot bar 15 and its socket 16 are positioned adjacent the rear of the mop and adjacent the upper surface of the wings with the ends or edges 11 extending forwardly as radius arms from the pivot bar, so that on movement of the lever, these edges 11 or radius arms sweep downwardly squeezing the wings together.

The mop is formed of two basic parts only, the mop and the actuator with its integral lever, the sponge being easily replaceable as desired.

As all the materials are formed of suitable plastics materials, such as polypropylene, a very light and easily operable mop is produced by simply moulding the two elements and then clipping them together.

Although one form of the invention has been described in some detail it is to be realised that various alterations and modifications may be made thereto without departing from the spirit and scope of the invention.

I claim:

1. A squeeze mop comprising a mop body, and a pair of wings hinged to the mop body at opposite sides thereof with a mopping element affixed to the undersurface of the wings, the mop body having a socket for the reception of a handle of the mop, characterized by a one piece actuator pivoted to the mop body, the actuator comprising a lever including a handle and a pair of members to engage the wings, the actuator being pivoted about an axis transverse to the hinging of the wings to the body and the pivotal axis being adjacent the rear of the wings, the pair of members straddling the handle socket and having portions extending forwardly as radius arms from the pivotal axis of the actuator, flat bottom surfaces of the radius arms being in engagement with the wings to form stops to limit upward movement of the wings, actuation of the lever forwardly forcing the wings downwardly, and the final squeezing is caused by the inside surfaces of the members engaging the upper surfaces of the wings with a wedging or camming action.

2. A mop as defined in claim 1 characterized by heel means formed on each wing at a front corner of the flat bottom surfaces to engage the wings and start the wings to move downwardly on initial squeezing movement of the lever.

3. A mop as defined in claim 2 characterized in that the lever is a one piece molded plastic structure with the two members each having an inner wall extending upwardly from said flat bottom surface to engage the wings on continued operative lever movement.

4. A mop as defined in claim 1 characterized in that the actuator is a one piece structure with the two members being joined by a pivot pin and clipped into a socket in the body.

5. A mop as defined in claim 1 wherein the upper surface of the wings and the inner surfaces of the members engage via tapered members to provide an increasing squeezing pressure on the wings.

6. A mop as defined in claim 1 characterized by the lever being a one piece molded plastic structure with the two members being parallel and each having an inner wall forming the inside surfaces extending upwardly from said flat bottom surfaces to engage the wings on continued operative lever movement, and the plastic surface has an integral pivot pin extending between the walls and being in pivotal engagement with a rear portion of the mop body, and the lever includes an upper portion connecting to the members and extending therebetween to form an operating handle for the lever.

* * * * *